US005863264A

United States Patent [19]

Yamagishi et al.

[11] Patent Number: 5,863,264

[45] Date of Patent: Jan. 26, 1999

[54] TWO-PIECE SOLID GOLF BALL

[75] Inventors: Hisashi Yamagishi; Atsushi Nakamura, both of Chichibu, Japan

[73] Assignee: Bridgestone Sports Co., Ltd., Tokyo, Japan

[21] Appl. No.: 780,824

[22] Filed: Jan. 10, 1997

[30] Foreign Application Priority Data

Jan. 12, 1996 [JP] Japan ..... 8-022113

[51] Int. Cl.[6] ..... A63B 37/06; A63B 37/12; A63B 37/14

[52] U.S. Cl. ..... 473/377; 473/384; 273/DIG. 20

[58] Field of Search ..... 473/377, 384; 283/DIG. 20

[56] References Cited

U.S. PATENT DOCUMENTS 4,570,937 2/1986 Yamada ..... 473/377

4,840,381 6/1989 Ihara et al. ..... 473/384 X 5,439,227 8/1995 Egashira et al. ..... 473/377 X 5,497,996 3/1996 Cadorniga ..... 473/377 X

*Primary Examiner*—George J. Marlo

*Attorney, Agent, or Firm*—Sughrue, Mion, Zinn, Macpeak & Seas, PLLC

[57] ABSTRACT

In a 2-piece solid golf ball comprising a solid core and a cover, the golf ball has a weight of 41–44.5 grams, the cover is formed of a thermoplastic resin having a Shore D hardness of 50–68 degrees, and the solid core has a surface hardness of 65–85 degrees and a center hardness of 60–80 degrees as measured by a JIS-C scale hardness meter, with the surface hardness≧ the center hardness+5. Despite a light weight, the golf ball is improved in flying distance and feel when hit at a relatively low head speed of 35–40 m/sec. The golf ball is thus appropriate for players of the beginner to middle rank.

11 Claims, 3 Drawing Sheets

TWO-PIECE SOLID GOLF BALL

BACKGROUND OF THE INVENTION

1. Field of the Invention

This invention relates to a two-piece solid golf ball suitable for those golf players who swing at a relatively low head speed.

2. Prior Art

For golf balls, various proposals have been made for improving their flying distance and hitting feel. Most of these advanced golf balls are targeted to those golf players who swing at a relatively high head speed, that is, experienced players. These golf players are capable of high head speed swing and can take advantage of the advanced balls, enjoying an increased flying distance and a pleasant feel. However, those golf players who swing at a low speed and are slow in head speed, including beginner, female and senior players cannot take full advantages of the advanced balls including an increased flight distance and pleasant feel.

Usually, players with a slow head speed select softer types of the advanced balls. Since the softer balls, however, are not originally designed optimum for slow-head-speed players, the balls follow a low trajectory rather than a high trajectory and offer a less pleasant feel upon hitting.

SUMMARY OF THE INVENTION

An object of the present invention is to provide a novel and improved 2-piece solid golf ball which is increased in flying distance and gives a pleasant feel when those golf players who are slow in head speed, including beginner, female and senior players use it.

The invention is directed to a 2-piece solid golf ball comprising a solid core and a cover. We have found that the flight distance and hitting feel of the ball is improved when the golf ball has a light weight of 41 to 44.5 grams, the cover is formed of a thermoplastic resin having a Shore D hardness of 50 to 68 degrees, and the solid core has a surface hardness of up to 85 degrees and a center hardness of up to 80 degrees as measured by a JIS-C scale hardness meter, the surface hardness being greater than the center hardness by at least 5 degrees.

When a golf ball is hit into the air by a club, gravity (g), an aerodynamic lift (L) and an aerodynamic drag (D) act on the flying ball.

$$\text{Lift } L=\tfrac{1}{2}\rho V^2 S C_L \quad (1)$$

$$\text{Drag } D=\tfrac{1}{2}\rho V^2 S C_D \quad (2)$$

ρ: air density

V: ball velocity

S: ball cross-sectional area $C_L$: lift coefficient $C_D$: drag coefficient

An inertial force F acts on the ball which is expressed by:

$$\text{inertial force } F=mg+D+L \quad (3)$$

wherein the ball has a mass m. Kinetic equations of the golf ball flying through the air are expressed by the equations:

$$mx=-D\cos\theta-L\sin\theta \quad (4)$$

$$my=-mg-D\sin\theta+L\cos\theta \quad (5)$$

wherein θ is an in-flight angle of the ball relative to the ground or horizontal plane.

It is understood that as the mass of the ball is reduced, the inertial force is reduced as seen from equation (3), resulting in a reduced flying distance. This is contradictory to the general demand on golf balls for increased flying distances. On the other hand, the gravitational action on the ball is reduced as seen from equation (5), resulting in a higher trajectory.

We have found that for those players who swing at a low head speed, a golf ball having a relatively lighter weight is adequate in that the player can hit the ball high so as to follow a high trajectory. However, a lightweight ball is accompanied by a reduction of flying distance as mentioned above. We have found that this problem can be overcome by properly selecting hardness parameters of the core and cover. By selecting a cover of proper hardness and a graded hardness core, there is obtained a 2-piece solid golf ball which gives a pleasant feel upon hitting and can travel a long distance even when hit at a head speed as low as 35 m/sec.

Accordingly, the present invention provides a 2-piece solid golf ball comprising a solid core and a cover enclosing the core and having a plurality of dimples formed on its surface. The golf ball has a weight of 41 to 44.5 grams. The cover is formed of a thermoplastic resin having a Shore D hardness of 50 to 68 degrees. The solid core has a surface hardness of up to 85 degrees and a center hardness of up to 80 degrees as measured by a JIS-C scale hardness meter, the surface hardness being greater than the center hardness by at least 5 degrees, that is, surface hardness≧center hardness+5.

In one preferred embodiment, the dimples formed on the cover surface range in number to 360 to 450 and have a diameter of 2.0 to 4.2 mm, a depth of 0.15 to 0.30 mm, and a $V_0$ value of at least 0.4. Note that $V_0$ is the volume of the dimple space below a plane circumscribed by the dimple edge divided by the volume of a cylinder whose bottom is the plane and whose height is the maximum depth of the dimple from the bottom.

In a further preferred embodiment, the dimples include dimples of one type having a larger diameter and dimples of another type having a smaller diameter. The dimples of the one type have a greater depth than the dimples of the other type.

BRIEF DESCRIPTION OF THE DRAWINGS

These and further features of the present invention will be apparent with reference to the following description and drawings, wherein.

DETAILED DESCRIPTION OF THE INVENTION

Figure 4:
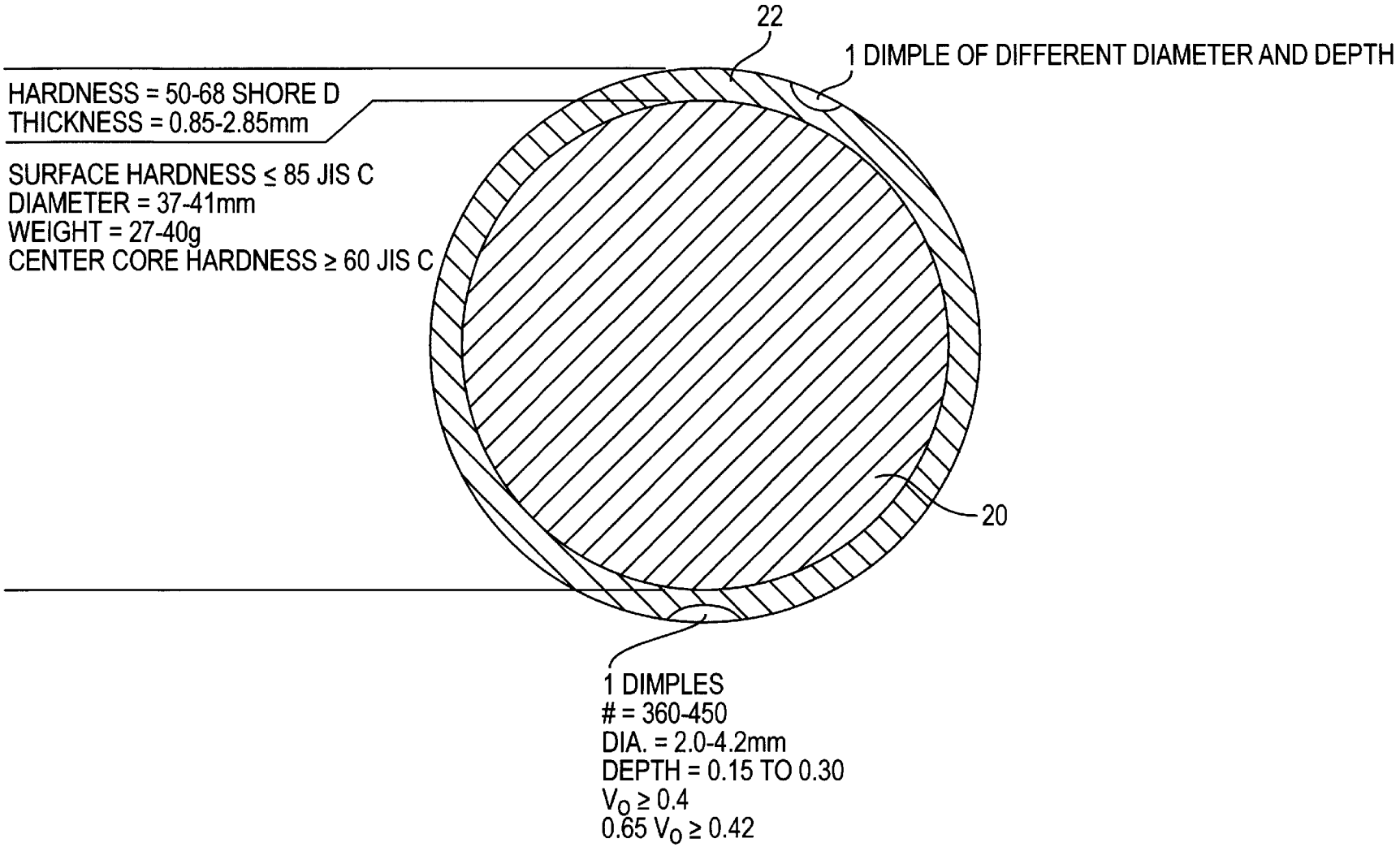
FIG. 4 is a cross-sectional view of a golf ball in accordance with this invention.

The 2-piece solid golf ball of the present invention has a solid core 20 and a cover 22 enclosing the core see FIG. 4.

According to the invention, the hardness distribution of the solid core is optimized. When the solid core is measured for hardness by a JIS-C scale hardness meter, the core has a hardness of up to 85 degrees on the surface (to be referred to as surface hardness). Preferably the core has a surface hardness of up to 80 degrees, more preferably up to 75 degrees. At the same time, the core has a hardness of up to 80 degrees at the center (to be referred to as center hardness). Preferably the core has a center hardness of up to 75 degrees, more preferably up to 70 degrees. The surface hardness is greater than the center hardness. The difference between the surface hardness and the center hardness should be at least 5 degrees. That is, surface hardness≧center hardness+5. Preferably the hardness difference is 7 degrees or more. Outside this hardness distribution, any improvement in flying distance and feel upon low head speed shots are not expectable. To ensure restitution, the lower limit of surface hardness should preferably be 65 degrees, more preferably 68 degrees. The lower limit of center hardness should preferably be 60 degrees, more preferably 63 degrees in order to maintain high restitution. The upper limit of the difference between the surface hardness and the center hardness should preferably be 20 degrees, especially 18 degrees.

The hardness range is summarized below wherein Hs is surface hardness and Hc is center hardness.

| Invention | Preferred | More preferred |
|---|---|---|
| 85 ≧ Hs | 80 ≧ Hs ≧ 65 | 75 ≧ Hs ≧ 68 |
| 80 ≧ Hc | 70 ≧ Hc ≧ 60 | 70 ≧ Hc ≧ 63 |
| Hs-Hc ≧ 5 | 20 ≧ Hs-Hc ≧ 5 | 18 ≧ Hs-Hc ≧ 7 |

The solid core may be formed from conventional solid core stock materials by conventional methods while formulation and vulcanizing conditions are adjusted so as to meet the core requirement of the invention. Most often, the core is formed of a composition comprising a base rubber, a crosslinking agent, a co-crosslinking agent, and an inert filler as used in the formation of conventional solid cores. The base rubber used herein may be natural rubber and/or synthetic rubber conventionally used in solid golf balls although 1,4-polybutadiene having at least 40% of cis-structure is especially preferred in the invention. The polybutadiene may be blended with a suitable amount of natural rubber, polyisoprene rubber, styrene-butadiene rubber or the like if desired.

The crosslinking agent includes organic peroxides such as dicumyl peroxide and di-t-butyl peroxide, with dicumyl peroxide being preferred. The crosslinking agent is usually blended in an amount of about 0.5 to 3 parts, preferably about 0.8 to 1.5 parts by weight per 100 parts by weight of the base rubber.

The co-crosslinking agent used herein is not critical. Examples include metal salts of unsaturated fatty acids, inter alia, zinc and magnesium salts of unsaturated fatty acids having 3 to 8 carbon atoms (e.g., acrylic acid and methacrylic acid), with zinc acrylate being especially preferred. The co-crosslinking agent is usually blended in an amount of about 5 to 45 parts, preferably about 10 to 40 parts by weight per 100 parts by weight of the base rubber.

Examples of the inert filler include zinc oxide, barium sulfate, silica, calcium carbonate, and zinc carbonate, with zinc oxide being often used. The amount of the filler blended is usually 0 to about 40 parts by weight per 100 parts by weight of the base rubber although the amount largely varies with the specific gravity of the core and cover, the weight of the ball, and other factors and is not critical. The weight of the core can be adjusted to an optimum value by properly adjusting the amount of the filler blended.

A core-forming composition is prepared by kneading the above-mentioned components in a conventional mixer such as a Banbury mixer and roll mill, and it is compression or injection molded in a core mold. The molding is then cured by heating at a sufficient temperature for the crosslinking agent and co-crosslinking agent to function (for example, a temperature of about 130° to 170° C. for a combination of dicumyl peroxide as the crosslinking agent and zinc acrylate as the co-crosslinking agent), obtaining a solid core.

A core satisfying the above-mentioned hardness requirement can be obtained by properly selecting the type and amount of blending ingredients, especially crosslinking and co-crosslinking agents and vulcanizing conditions.

The solid core preferably has a diameter of 37 to 41 mm, especially 38 to 40 mm and a weight of 27 to 40 grams, especially 30 to 37 grams.

The cover enclosing the core is formed of a thermoplastic resin having a Shore D hardness of 50 to 68 degrees. Restitution would be low with a cover hardness of less than 50 degrees whereas durability would be low with a cover hardness of more than 68 degrees.

The thermoplastic resins used herein include ionomer resins, polyester elastomers, polyamide elastomers, thermoplastic urethane elastomers, propylene-butadiene copolymers, 1,2-polybutadiene, and styrene-butadiene copolymers alone or in admixture of two or more. Preferred among these are ionomer resins, which are typically copolymers of a monoolefin with at least one selected from the group consisting of unsaturated mono- and di-carboxylic acids having 3 to 8 carbon atoms and esters thereof, with bridging metal bonds added. A cover composition comprising an ionomer resin and optional ingredients is applied onto the core by conventional methods such as injection molding and compression molding, obtaining a 2-piece solid golf ball according to the invention.

Preferably the cover has a gage (or radial thickness) of 0.85 to 2.85 mm, especially 1.4 to 2.3 mm.

The golf ball of the invention preferably has a diameter of 42.7+0.05 mm and a weight of 41 to 44.5 grams, especially 42 to 44 grams. Balls with a weight of more than 44.5 grams are as conventional and not adequate for low-head speed players.

Like conventional golf balls, the golf ball of the invention is formed with a multiplicity of dimples in the cover surface. Preferably the ball has about 360 to 450 dimples, more preferably about 370 to 432 dimples. The dimples may be arranged in any desired pattern as in conventional golf balls. There may be two or more types of dimples which are different in diameter and/or depth. It is preferred that the dimples have a diameter of 2.0 to 4.2 mm and a depth of 0.15 to 0.30 mm. While the inventive golf ball is adequate for those golfers with a slow head speed, improvements in flight distance and feel become a little unsatisfactory outside this range. Better aerodynamics are expectable if the dimples are formed to satisfy the condition: $V_0 \geqq 0.4$, especially $0.65 \geqq V_0 \geqq 0.42$. $V_0$ is defined as follows. It is assumed that each dimple has a circular edge and the ball has a radius R. Then the dimple space below a circular plane circumscribed by the dimple edge has a volume (Vp), and a cylinder whose bottom is the circular plane and whose height is the maximum depth of the dimple from the bottom has a volume (Vq). $V_0$ is the dimple space volume (Vp) divided by the cylinder volume (Vq). If $V_0$ is less than 0.4, the ball would climb up and even stall, failing to travel a long distance. If $V_0$ is too high, the trajectory would tend to descend.

Figure 1:
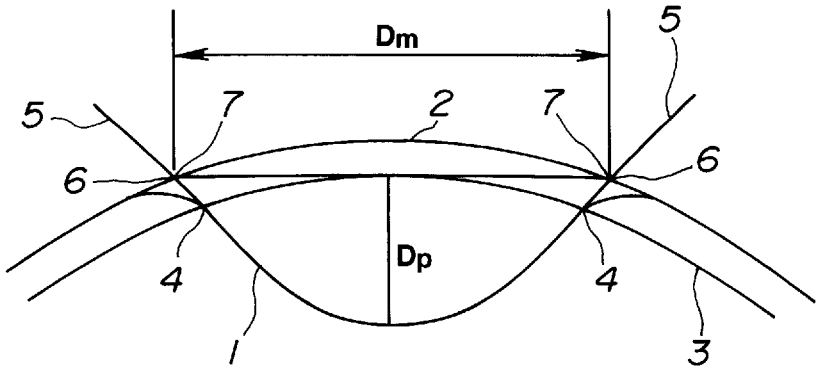
FIGS. 1, 2, and 3 are schematic views illustrating how to calculate the dimple space volume and cylinder volume.
Figure 2:
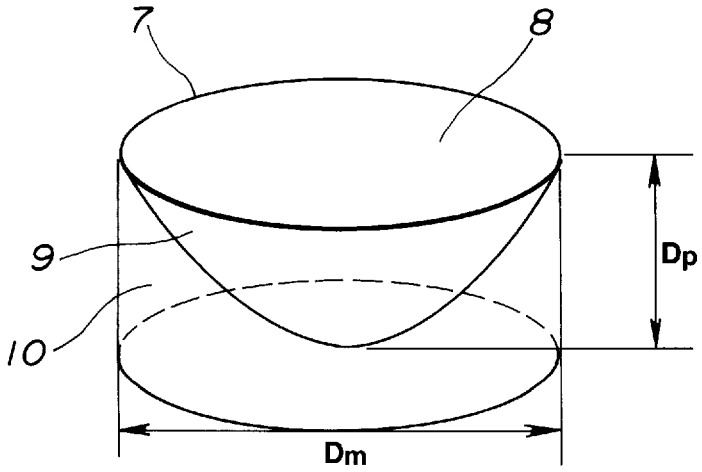
Figure 3:
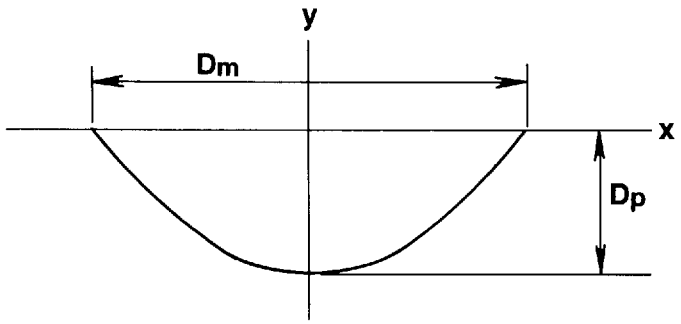

Referring to FIGS. 1 to 3, the shape of dimples is described in further detail. For simplicity sake, it is now assumed that the shape of a dimple projected on a plane is circular. One dimple in a ball surface is shown in the schematic cross-sectional view of FIG. 1. The ball with a radius R has dimples, one of which is depicted at 1, in its spherical surface. In conjunction with the dimple 1, there are drawn a phantom sphere 2 having the ball diameter 2 R and another phantom sphere 3 having a diameter smaller by 0.16 mm than the ball diameter. The other sphere 3 intersects with the dimple 1 at a point 4. A tangent 5 at intersection 4 intersects with the phantom sphere 2 at a point 6. A series of intersections 6 define a dimple edge 7. The dimple edge 7 is so defined for the reason that otherwise, the exact position of the dimple edge cannot be determined because the actual edge of the dimple 1 is rounded. The dimple edge 7 circumscribes a circular plane 8 having a diameter Dm. Then as shown in FIG. 2, the dimple space 9 located below the circular plane 8 has a volume Vp. A cylinder 10 whose bottom is the circular plane 8 and whose height is the maximum depth Dp of the dimple from the bottom or circular plane 8 has a volume Vq. As shown in FIG. 3, the volume Vp of the dimple space 9 and the volume Vq of the cylinder 10 are calculated according to the following equations. The dimple space volume Vp is divided by the cylinder volume Vq to give a ratio $V_0$.

$$Vp = \int_0^{\frac{Dm}{2}} 2\pi xydx$$

$$Vq = \frac{\pi Dm^2 Dp}{4}$$

-continued $$V_0 = \frac{Vp}{Vq}$$

It is noted that an equivalent diameter is used in the event that the shape of a dimple projected on a plane is not circular. That is, the maximum diameter or length of a dimple projected on a plane is determined, the plane projected shape of the dimple is assumed to be a circle having a diameter equal to this maximum diameter or length, and $V_0$ is calculated as above based on this assumption.

Where there are formed dimples of two or more types (usually 2 to 5 types, most often 2 or 3 types) which are different in diameter and/or depth, it is recommended for a longer carry that those dimples having a larger diameter Dm have a greater maximum depth Dp than those dimples having a smaller diameter Dm.

EXAMPLE

Examples of the present invention are given below by way of illustration and not by way of limitation. All parts are by weight.

Examples 1–4 & Comparative Examples 1–4

Core stock components as shown in Table 1 were milled and molded into a core. The core was thoroughly vulcanized in the mold at 155° C. for about 20 minutes, obtaining a solid core having a center hardness and a surface hardness as shown in Table 1. The core was measured for hardness by cutting the core into two halves and measuring the hardness of the core half section at the center (center hardness) and at the circumference (surface hardness) by means of a JIS-C scale hardness meter. An average of five measurements was reported.

Cover stock components as shown in Table 1 were milled. The compound was injection molded over the solid core while dimples A or B as shown in Table 2 were formed in the cover surface. The thus obtained golf ball had a weight and outer diameter as shown in Table 1.

TABLE 1

| | E1 | E2 | E3 | E4 | CE1 | CE2 | CE3 | CE4 |
|---|---|---|---|---|---|---|---|---|
| Core composition (pbw) | | | | | | | | |
| Cis-1,4-polybutadiene rubber | 95 | 90 | 90 | 100 | 100 | 77 | 70 | 90 |
| Polyisoprene rubber | 5 | 10 | 10 | — | — | 23 | 30 | 10 |
| Zinc acrylate | 23.0 | 23.5 | 24.5 | 17.7 | 20.5 | 37.0 | 42.0 | 24.5 |
| Zinc oxide | 12.8 | 7.0 | 11.5 | 15.1 | 24.5 | 11.5 | 3.6 | 11.5 |
| Dicumyl peroxide | 0.9 | 0.9 | 0.9 | 0.9 | 0.9 | 0.9 | 0.9 | 0.9 |
| Cover composition (pbw) | | | | | | | | |
| Himilan 1557 | 50 | 50 | 50 | 50 | — | 50 | — | 50 |
| Himilan 1601 | 50 | 50 | — | 50 | — | 50 | — | — |
| Himilan 1605 | — | — | 50 | — | — | — | — | 50 |
| Surlyn 8220 | — | — | — | — | 50 | — | 50 | — |
| Himilan 7315 | — | — | — | — | 50 | — | 50 | — |
| Golf ball parameters | | | | | | | | |
| Core Center hardness (JIS-C) | 60 | 65 | 69 | 53 | 65 | 82 | 76 | 69 |
| Surface hardness (JIS-C) | 70 | 73 | 76 | 62 | 72 | 83 | 87 | 76 |
| Hardness difference | 10 | 8 | 7 | 9 | 7 | 1 | 11 | 7 |
| Cover Hardness (Shore D) | 58 | 58 | 60 | 58 | 67 | 58 | 67 | 60 |
| Ball Weight (g) | 43.8 | 42.5 | 43.0 | 43.8 | 45.3 | 44.0 | 43.5 | 43.0 |
| Diameter (mm) | 42.7 | 42.7 | 42.7 | 42.7 | 42.7 | 42.7 | 42.7 | 42.7 |
| Dimple | A | A | A | A | A | A | A | B |

TABLE 2

| Dimple | Diameter (mm) | Depth (mm) | $V_0$ | Number |
|---|---|---|---|---|
| A | 4.000 | 0.180 | 0.425 | 60 |
| | 3.800 | 0.170 | 0.425 | 240 |
| | 2.500 | 0.140 | 0.425 | 72 |
| B | 3.750 | 0.200 | 0.450 | 336 |

Using a swing robot manufactured by True Temper Co., the golf balls were hit by #W1 at a head speed of 35.0 m/sec. and by #W4 at a head speed of 32.0 m/sec. for determining a total distance (carry plus run).

Using a panel of three golf players (head speed 35–40 m/sec.), the balls were evaluated for ease of high hitting and hitting feel according to the following rating.

Ease of high hitting

⊙: easy

O: ordinary

X: difficult

Feel

⊙: soft

O: ordinary

X: hard

The results are shown in Table 3.

TABLE 3

| | | E1 | E2 | E3 | E4 | CE1 | CE2 | CE3 | CE4 |
|---|---|---|---|---|---|---|---|---|---|
| #W1 | Total distance (m) | 195.0 | 197.0 | 195.5 | 196.0 | 190.0 | 189.0 | 193.0 | 187.0 |
| | High hitting | ⊙ | ⊙ | ⊙ | ⊙ | ○ | ○ | ⊙ | X |
| | Hitting feel | ⊙ | ⊙ | ⊙ | ⊙ | ○ | X | X | ⊙ |
| #W4 | Total distance (m) | 170.0 | 170.5 | 171.0 | 170.0 | 162.0 | 161.5 | 161.0 | 158.5 |
| | High hitting | ⊙ | ⊙ | ⊙ | ⊙ | ○ | ○ | ⊙ | X |
| | Hitting feel | ⊙ | ⊙ | ⊙ | ⊙ | X | X | X | ⊙ |

Despite a light weight of 41 to 44.5 grams, the 2-piece solid golf ball of the invention is improved in flying distance and feel when hit at a relatively low head speed of 35 to 40 m/sec. The golf ball is thus appropriate for players of the beginner to middle rank.

Although some preferred embodiments have been described, many modifications and variations may be made thereto in the light of the above teachings. It is therefore to be understood that within the scope of the appended claims, the invention may be practiced otherwise than as specifically described.

We claim:

1. A two-piece solid golf ball comprising, a solid core and a cover enclosing the core and having a multiplicity of dimples formed on its surface, wherein the golf ball has a weight of 41 to 44.5 grams, the cover is formed of a thermoplastic resin having a Shore D hardness of 50 to 68 degrees, and the solid core has a surface hardness of up to 85 degrees and a center hardness of up to 80 degrees as measured by a JIS-C scale hardness meter, the surface hardness being greater than the center hardness by at least 5 degrees.

2. The two-piece solid golf ball of claim 1 wherein the number of dimples formed on the cover surface range from 360 to 450 and each have a diameter of 2.0 to 4.2 mm, a depth of 0.15 to 0.30 mm, and a $V_0$ value of at least 0.4 wherein $V_0$ is the volume of the dimple space below a plane circumscribed by the dimple edge divided by the volume of a cylinder whose bottom is the plane and whose height is the maximum depth of the dimple from the bottom.

3. The golf ball of claim 2 wherein $0.65 \geqq V_0 > 0.42$.

4. The two-piece solid golf ball of claim 1 wherein the dimples include dimples of one type having a larger diameter and dimples of another type having a smaller diameter, the dimples of the one type having a greater depth than the dimples of the other type.

5. The golf ball of claim 1 wherein $20 \geqq H_s - H_c \geqq 5$ where $H_s$ is the surface hardness of the core and $H_c$ is the center hardness of the core.

6. The golf ball of claim 1 wherein said cover has a thickness in the range of 0.85–2.85 mm.

7. The golf ball of claim 1 wherein the surface hardness of said core is greater than said center hardness of said core by at least 7 degrees.

8. The golf ball of claim 1 wherein said center hardness of the core is at least 60 degrees.

9. The golf ball of claim 1 wherein said surface hardness of the core is at least 65 degrees.

10. The golf ball of claim 1 wherein said solid core has a diameter in the range of 37 to 41 mm.

11. The golf ball of claim 1 wherein said solid core has a weight in the range of 27 to 40 grams.

* * * * *